US009545666B2

(12) United States Patent
Calin et al.

(10) Patent No.: US 9,545,666 B2
(45) Date of Patent: Jan. 17, 2017

(54) METHOD FOR CASTING CAST PARTS FROM A MOLTEN METAL

(71) Applicant: Nemak, S.A.B. de C.V., Garcia (MX)

(72) Inventors: Liviu Calin, Linz (AT); Friedrich Irauschek, Ennsdorf (AT); Walter Hartl, Weiten (AT); Reinhard Mann, Traun (AT)

(73) Assignee: Nemak, S.A.B. de C.V., Garcia (MX)

( * ) Notice: Subject to any disclaimer, the term of this patent is extended or adjusted under 35 U.S.C. 154(b) by 0 days.

(21) Appl. No.: 15/100,778

(22) PCT Filed: Dec. 2, 2014

(86) PCT No.: PCT/EP2014/076292

§ 371 (c)(1),
(2) Date: Jun. 1, 2016

(87) PCT Pub. No.: WO2015/082489

PCT Pub. Date: Jun. 11, 2015

(65) Prior Publication Data

US 2016/0303647 A1 Oct. 20, 2016

(30) Foreign Application Priority Data

Dec. 3, 2013 (DE) ..... 10 2013 113 414
Feb. 28, 2014 (DE) ..... 10 2014 102 724

(51) Int. Cl.

| | |
|---|---|
| ***B22D 41/04*** | (2006.01) |
| ***B22D 23/00*** | (2006.01) |
| ***B22D 41/06*** | (2006.01) |
| ***B22D 33/02*** | (2006.01) |

(52) U.S. Cl.

CPC ..... *B22D 23/006* (2013.01); *B22D 33/02* (2013.01); *B22D 41/04* (2013.01); *B22D 41/06* (2013.01)

(58) Field of Classification Search

CPC ..... B22D 23/006
USPC ..... 164/136, 336
See application file for complete search history.

(56) References Cited

U.S. PATENT DOCUMENTS

| | | | | |
|---|---|---|---|---|
| 3,333,625 | A * | 8/1967 | Fromson | B22D 23/006 164/136 |
| 5,704,413 | A | 1/1998 | Takasaki et al. | |
| 8,245,759 | B2 | 8/2012 | Goettsch | |

FOREIGN PATENT DOCUMENTS

| | | | |
|---|---|---|---|
| DE | 102004015649 | B3 | 8/2005 |
| DE | 102008015856 | A1 | 10/2009 |
| DE | 102009023881 | A1 | 1/2010 |
| DE | 102010022343 | A1 | 12/2011 |
| EP | 1155763 | A1 | 11/2001 |
| WO | 2014190366 | A1 | 12/2014 |

* cited by examiner

*Primary Examiner* — Kevin E Yoon
(74) *Attorney, Agent, or Firm* — The Webb Law Firm

(57) ABSTRACT

A casting mold is pivoted about a horizontal pivot axis for casting cast parts in a casting machine. The casting mold has a lid and a reference side wall. A main plane is placed into the reference side wall. A tundish is coupled to the casting mold and the casting mold is then pivoted into a pouring-in position. The tundish filled with a molten metal portion is pivoted with the casting mold about the pivot axis, so that the molten metal flows into the casting mold. An angle β1 enclosed between the main plane of the reference side wall and a bath level of the molten metal portion in the tundish is constantly <180° until the melt hits the bottom of the casting mold.

18 Claims, 5 Drawing Sheets

METHOD FOR CASTING CAST PARTS FROM A MOLTEN METAL

CROSS-REFERENCE TO RELATED APPLICATIONS

This application is the United States national phase of International Application No. PCT/EP2014/076292 filed Dec. 2, 2014, and claims priority to German Patent Application Nos. 10 2013 113 414.9 and 10 2014 102 724.8 filed Dec. 3, 2013 and Feb. 28, 2014, respectively, the disclosures of which are hereby incorporated in their entirety by reference.

BACKGROUND OF THE INVENTION

Field of the Invention

The invention relates to a method for casting cast parts from a molten metal.

Description of Related Art

A fundamental problem when casting cast parts from a molten metal is to fill the mould with the molten material in such a way that as little air and oxide inclusions as possible occur in the cast part. In addition, with many applications, a certain course of solidification is sought, in order to obtain a microstructure formation which meets the respective requirements for the distribution of the mechanical properties.

It should also be added here that particularly when casting Al alloys the melt should get from the melt tank or casting vessel into the mould as quickly as possible. In this way, the case of alloying constituents reacting with the ambient oxygen and forming hard oxides is prevented. At the same time, the temperature losses during casting are to be minimised, in order to ensure an optimum microstructure formation. These requirements are faced with the risk that, when the melt is filled into the mould quickly, considerable turbulence occurs in the melt flow and gases are trapped in the cast part, whereby the formation of an optimum microstructure in the cast part is hampered.

Filling the respective casting mould with little turbulence "smoothly" is particularly important, especially where parts are cast which are required for constructing internal combustion engines, such as cylinder heads or crankcases, consisting of a light metal melt, in particular a melt based on aluminium. The amount of oxides and other impurities which swim on the melt volume to be filled into the casting mould and otherwise get into the casting mould during casting can hereby be minimised. In the past, a large number of variants of so-called "tilt casting" were developed in order to achieve this.

The common characteristic of the known tilt casting methods is that the casting mould is filled via a melt vessel coupled to it by rotating it with the melt vessel from a starting position, in which the melt vessel is filled with the melt to be cast, about a pivot axis into an end position, so that as a result of this pivoting movement the melt flows into the casting mould.

In one variant of tilt casting known from EP 1 155 763 A1, a casting mould with a pouring-in side pointing upwards is built onto a base plate and is then rotated with the base plate by approximately 180° about a horizontal pivot axis until the pouring-in side of the casting mould points downwards. Then, a casting vessel which is filled with a melt portion which is sufficient to fill the casting mould is coupled in a sealing manner with its pouring-out opening to the pouring-in side of the casting mould. The casting mould is subsequently rotated together with the casting vessel butting against it by approximately 180° about a horizontally aligned pivot axis, so that the melt flows out of the casting vessel into the casting mould. When the flowing-in process is complete, the casting vessel can be removed from the casting mould. Methods of this type are also called rotational casting methods due to the wide pivot distance covered.

A further method for tilt casting is known from DE 10 2004 015 649 B3, by means of which components consisting of light metal, in particular consisting of aluminium alloys, are cast. In this method, the melt is filled into a transverse run situated on the longitudinal side of a casting mould using head-casting. The casting mould is firstly tilted by an angle of 45° to 70° about its horizontally aligned longitudinal axis. Afterwards, filling the molten melt into the transverse run starts until about one fifth of the melt required for casting the component has been filled into the transverse run without the melt already flowing into the mould cavity of the casting mould. Then, the casting mould while melt is continuously filled further is rotated out of the tilted position into the vertical position such that the melt flows into the mould cavity along a casting mould wall.

A further variant of a method for casting components consisting of light metal according to the tilt casting principle is known from DE 10 2008 015 856 A1. In this method, the melt is filled into an assembly assigned to the casting mould. During a tilting movement of the casting mould, melt flows out of this assembly into the mould cavity. By pivoting the casting mould starting from an end position into a starting position of up to 90° about a horizontally aligned pivot axis by means of an assigned casting machine and by the casting mould then being displaceable in a range from 0° to 90°, geometrically exacting components with a good microstructure formation are supposed to be able to be cast within short cycle times in terms of solidification.

Finally, a method for tilt casting components is known from DE 10 2010 022 343 A1, in which in a first production step a casting mould, which defines a mould cavity for receiving a molten metal and has at least one pouring basin, is pivoted from a normal position with the pouring-in side pointing upwards in a first pivoting direction about a first pivot angle into a first pivot position. Then, the casting mould is prepared for casting a new cast part, in which it is cleaned, optionally coated and equipped with foundry cores. The casting mould is subsequently pivoted in a second pivoting direction which is opposite to the first pivoting direction. It thereby passes through the normal position and is pivoted as far as a second pivot position, in which the casting mould in relation to the normal position has a second pivot angle. Then, the at least one pouring basin is filled with a molten metal provided for casting a component. Subsequently, the one casting mould is pivoted together with the pouring basin in the opposite direction into the normal position in such a way that the molten melt between the second pivot position and the normal position flows into the mould cavity of the casting mould in a laminar manner. An advantage of this variant of tilt casting is supposed to be that the pouring basin is arranged relatively far away from the operator and so the thermal radiation affecting the operator is comparatively low. At the same time, this known method for tilt casting with shorter cycle times and hence higher output quantities is also supposed to enable components to be cast with a higher level of quality.

Against the background of the prior art explained above, an object of the invention was to provide a method for casting cast parts, in which with a further optimised mould filling procedure and an accompanying optimised course of solidification an optimum quality of the cast parts is ensured.

SUMMARY OF THE INVENTION

In a method according to the invention for casting cast parts from a molten metal, a casting mould is accordingly used which is pivotably mounted about a horizontally aligned pivot axis in a casting machine and at the same time defines a mould cavity shaping the cast part to be cast in each case and having a lid delimiting the mould cavity on its one side, on which at least one filling opening is provided for feeding molten metal into the mould cavity, a reference side wall abutting on the lid and delimiting the mould cavity on its one side with wall areas, into which a main plane of the reference side wall running axially parallel to the pivot axis is placed in such a way that its alignment is approximated to the average of the alignments of the wall areas, which also in each case extend in a direction aligned parallel to the pivot axis, and a bottom whose bottom areas assigned to the mould cavity shape the bottom end of the cast part.

In addition, according to the invention a tundish is used which on its pouring-in side for pouring the molten metal into the tundish and on a pouring-out side abutting on the pouring-in side and on a bottom of the tundish is at least in sections open in each case, via which the molten metal filled into the tundish in casting operation flows out of the tundish into the casting mould.

According to the invention, then in a first production step the tundish is arranged on the casting mould in such a way that its pouring-out side butts against the lid of the casting mould and the bottom of the tundish is assigned to the reference side wall, wherein the pouring-in opening of the casting mould and the open section of the pouring-out side at least overlap one another.

Then, the casting mould is pivoted into a pouring-in position, in which the main plane of the reference side wall encloses an angle β1 that is less than 180° with the bath level of a molten metal portion to be filled into the tundish and the bath level of the molten metal portion to be filled into the tundish is located below the filling opening of the casting mould.

Subsequently, the tundish, which is in the pouring-in position, is filled with the molten metal portion which is sufficient for filling the casting mould.

Finally, the casting mould with the tundish arranged on it is pivoted about the pivot axis into a pivot direction, in which as a result of the pivoting and the effect of gravity molten metal flows out of the tundish into the casting mould, wherein the pivoting is continued until an end position is reached, in which the casting mould is filled with molten metal, and wherein the angle β1 enclosed in each case between the main plane of the reference side wall and the bath level of the molten metal portion, which is contained in the tundish in each case, is at least constantly less than 180° until the melt flowing into the casting mould hits the bottom of the casting mould.

Using the method according to the invention, the pivot distance can be considerably reduced compared to conventional rotational casting methods in which usually a pivot distance of 180° is covered. This results in a clear saving of time compared to these methods.

At the same time, both compared to the conventional rotational casting methods and compared to the conventional tilt casting methods, in which between the starting position, in which still no melt runs into the casting mould from the melt tank which is in each case coupled to the casting mould, and the end position, in which the casting mould is completely filled, usually a pivot distance of up to 110° is covered, a marked improvement in the mould filling process and as a consequence thereof a marked improvement in the casting outcome is obtained. Thus, with the approach according to the invention the kinetic energy which is conveyed to the melt contained in the tundish in the course of the pivoting movement is reduced to a minimum. In this way, turbulence in the melt contained in the tundish is prevented. The number of oxidic and other inclusions which get into the melt in the tundish via the surface is also correspondingly minimised.

This is accomplished by the fact that for carrying out the method according to the invention the pivot position of the combination consisting of the casting mould and tundish, which is arranged on it serving as a melt tank, is selected in the starting position such that after the molten metal portion required for filling the casting mould has been filled, the bath level of the molten metal portion encloses an angle β1 with the main plane of the reference side wall which is less than 180°.

According to the invention, this angle β1 is in each case measured between the main plane of the reference side wall and the free surface of the bath level which is virtual until filling of the molten metal portion takes place. The side wall of the casting mould, which when the tundish is coupled to the casting mould lies closest to the tundish, is referred to as the "reference side wall". The "main plane" of the reference side wall is then an imaginary plane which is spanned by a direction vector running parallel to the pivot axis of the casting mould and a second direction vector which, on the one hand, is aligned perpendicularly to the pivot axis and whose alignment, on the other hand, corresponds to the average of the alignments of vectors which are also positioned perpendicularly to the pivot axis and which are applied to those wall areas which in each case extend parallel to the pivot axis.

According to the invention, by corresponding pivoting of the casting mould/tundish combination, the angle β1 is selected for the pouring-in position such that it remains less than 180° during pivoting of the combination consisting of the casting mould and tundish, which starts after filling the required molten metal portion into the tundish serving as the melt tank, until the melt hits the bottom of the casting mould. This means that in the case of the method according to the invention, the melt to be poured in the course of the pivoting operation and its flow into the casting mould which accompanies this flows gently inclined against the inner wall areas of the reference side wall determining the position of the main plane, until the melt reaches the bottom of the casting mould. Hence, similar to a swell smoothly flowing against a gently inclined beach, at most minimal turbulence occurs in the melt entering the casting mould.

Consequently, in the course of the pivoting operation according to the invention the casting mould is particularly uniformly and smoothly flooded by the melt entering the casting mould as a result of the pivoting movement and the effect of gravity. In the case of the approach according to the invention, the cast part is gradually formed with increasing pivoting starting from the reference side wall in the mould cavity of the casting mould, until the end position of the pivot distance is reached and the casting mould is completely filled with melt.

Surprisingly, it has become apparent that flooding the casting mould as a result of the approach according to the invention takes place so smoothly that oxides and other impurities present on the molten bath in the tundish to the greatest possible extent remain outside the mould cavity of the casting mould without special measures being required for this. With such casting moulds, in which a recess is provided in the area of the lid for taking up a melt portion serving as a feeder for the cast part to be cast, the oxides and impurities accumulate correspondingly in an area close to the surface in which they pose no threat to the quality of the cast part. In this way, the occurrence of inclusions in cast parts produced according to the invention is reduced to a minimum. Structural measures or measures involving devices, such as arranging a retaining blade, a filter or a sieve in the area of the filling opening of the casting mould, or suchlike, is consequently not called for. Hence, the invention not only results in a clear saving of time compared to conventional rotational casting methods, but also to improved product properties of the cast parts obtained compared to such cast parts which are produced according to conventional tilt casting methods.

A further advantage of the invention is that a tundish of the simplest geometrical design open towards its pouring-in side during the filling and pivoting operations can be used as the casting vessel. By observing the specifications according to the invention, an easy to achieve pouring-in position results, in which the melt portion required in each case can be filled into the tundish by means of a conventional pouring ladle.

The filling opening provided in the lid of the casting mould can be designed for the method according to the invention so that filling can also take place from sections of the casting mould far away in relation to the filling opening in a direct inflow in each case. That is to say, optimally the filling opening is not restricted to a small surface section of the lid such that the melt gets into the casting mould in a concentrated, quickly flowing flow, but rather it is designed such that seen in a plan view of the lid it covers the surface occupied by the cross section of the mould cavity of the casting mould aligned parallel to the lid to the greatest possible extent. This can also be achieved by assigning to the individual sections of the casting mould distributed over the cross-sectional area their own filling opening in each case or a certain section of a large common filling opening. A plurality of filling openings can be formed for this purpose overlaying one another in such a way that they merge into one another in their intersection areas and in this way form a filling opening branching into two or more sections. The aim here is to have the largest possible filling opening to enable a large melt volume to enter the casting mould at the same time in a smooth flow avoiding local flow velocity peaks.

The smooth filling of the mould can also be supported by running the pivot axis, about which the casting mould is pivoted, through or close to the bottom of the casting mould. By means of this arrangement of the pivot axis which is eccentric in relation to the casting mould and is offset in the direction of the casting mould bottom, the incline and the accompanying kinetic energy with which the melt enters the casting mould are further reduced.

Due to the optimised casting results and minimised casting times, the method according to the invention is particularly suitable for mass-producing cylinder heads and crankcases for internal combustion engines, on whose mechanical and thermal suitability the highest requirements are imposed. Here, the advantages of the procedure according to the invention become apparent particularly if a light metal melt based on aluminium is used as the cast material.

The tundish can either be permanently connected to the casting mould for carrying out the method according to the invention or detachably held to the casting mould by means of suitable clamping devices. The latter design has the advantage that the tundish can be easily detached from the casting mould, for example to clean or replace it. At the same time, by means of a sufficient holding force it can be ensured that the joining positions where the tundish butts against the casting mould are reliably sealed and, in fact, also if due to the effect of heat or wear and tear the contact surfaces of the casting mould and tundish assigned to one another are no longer perfectly compatible with one another. Hydraulically functioning clamping devices, which can produce high clamping and holding forces in a small amount of space, are particularly suitable as the device for holding the tundish on the casting mould.

With regard to the uniformly smooth flow of the melt into the casting mould sought, it has proved particularly effective if the tundish has a bottom which is flat on its bottom area facing the molten metal. Optimally, the flat bottom area is aligned such that it is in a horizontal position at the earliest at the moment when the melt flowing into the casting mould hits the bottom of the casting mould.

When casting cast parts which have a clearly defined optimally flat top and bottom area, such as cylinder heads or crankcases for internal combustion engines, in which the casting mould correspondingly on the outside of the lid and bottom also has two outer surfaces aligned parallel to one another, it can be ensured that the bottom area of the tundish encloses a right angle with the bottom of the casting mould.

The tundish can be particularly easily arranged and aligned on the casting mould if the pouring-out side is open over the height and width of the tank area defined by the tundish. In the case of a casting mould in which a plurality of pouring-in openings or ingates are present in the lid, via which melt is to be distributed into the casting mould, this design has the additional advantage that the molten metal portion available in the tundish during pivoting flows uniformly over a large width against the lid of the casting mould and correspondingly flows uniformly into the openings present there in the casting mould.

The amount of oxides and other contaminants which are drawn into the molten metal portion filled into the tundish during the pouring-in operation can be minimised by the pouring-in operation itself also taking place in a flow which is as smooth as possible. This can be supported by forming an inflow surface on one of the sides of one of the closed side walls of the tundish facing the molten metal, this inflow surface being inclined starting from the bottom of the tundish in the direction of the upper free edge of this side wall and at which the molten metal is directed when the molten metal is poured into the tundish. The surge of melt striking the inclined surface formed in this way with the removal of kinetic energy is diverted such that it strikes the melt already present in the tundish over a widened front, so that the intensity and depth of the turbulence inevitably occurring there is minimised. Depending on how concentrated the pouring stream strikes the inflow surface when pouring the melt in, it can be advantageous if the inflow surface is designed concavely curved inwards, flat or concavely curved outwards.

Taking the above summarised proposals of the invention into consideration, a tundish the tank area of which has a basic rectangular shape, has proved to be particularly suitable, wherein the pouring-out side assigned to the casting mould and the top side of the tundish are open while the inflow surface is formed on the inner surface of the tundish opposite to the pouring-out side.

Practical experience has shown that particularly when casting cylinder heads and crankcases for internal combustion engines optimum casting results are obtained if before pivoting takes place the angle β1 enclosed between the surface of the bath level of the melt portion filled into the tundish and the main plane of the reference side wall is 120-160° when the casting mould is in the pouring-in position.

The casting mould can be filled via a distribution channel system formed on its lid or arranged upstream of the lid, if this is considered advantageous in terms of the casting or the flow of the melt. However, the particular advantages of the method according to the invention become particularly apparent if two or more ingates open out onto the lid as pouring-in openings, via which the melt flows directly into the mould cavity of the casting mould during pivoting. Here, it has also proved easily possible, due to the particularly smooth filling of the casting mould ensured by the invention, for the lid to be directly flowed against if it is formed from a moulding material as a lost mould core.

Correspondingly, the method according to the invention is particularly suitable for casting cast parts in casting moulds which are completely or at least partly as a so-called core package composed of a plurality of casting cores in particular preformed from moulding material. Such casting moulds are particularly suitable for producing delicately formed cast parts having a plurality of inner channels, as are required for constructing internal combustion engines.

In the method according to the invention, the pivot angle covered when pivoting the casting mould with the tundish arranged on it between the pouring-in position and the end position is typically in the range from at least 110° to 160°, wherein in practice pivot angles of 120°-150° have proved particularly effective.

BRIEF DESCRIPTION OF THE DRAWINGS

The invention is explained in more detail below with the aid of figures illustrating an exemplary embodiment, in each case there being shown schematically FIG. 1 a casting machine for casting cast parts pivoted into a normal position in a side view.

DETAILED DESCRIPTION OF THE INVENTION

Figure 1:
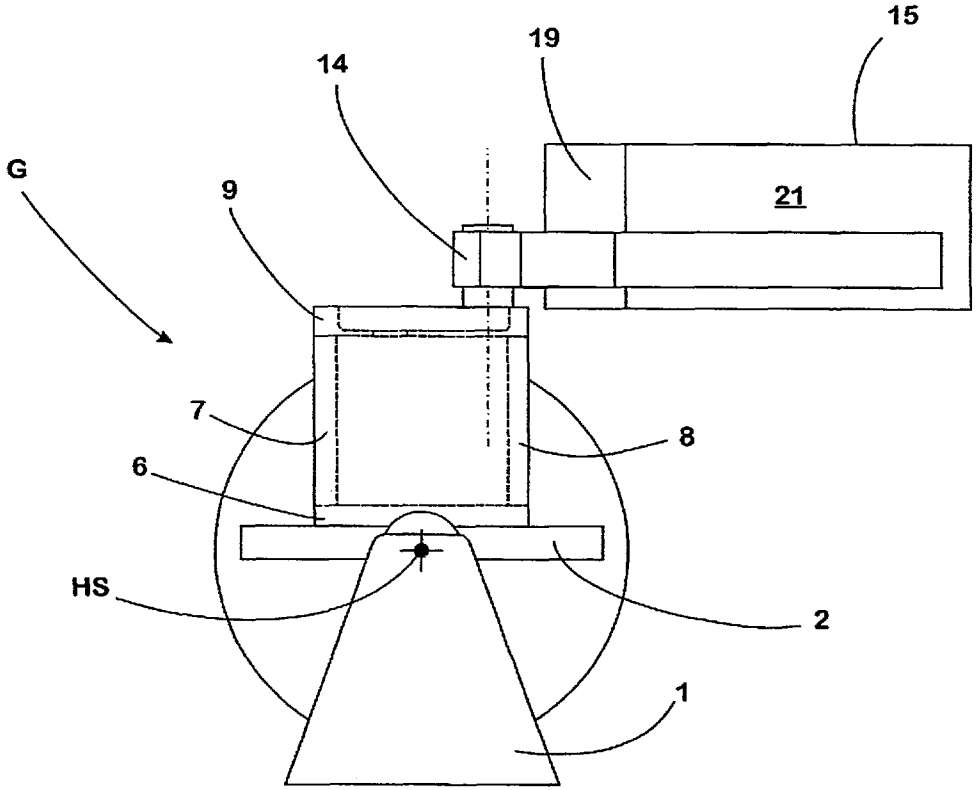
Figure 2:
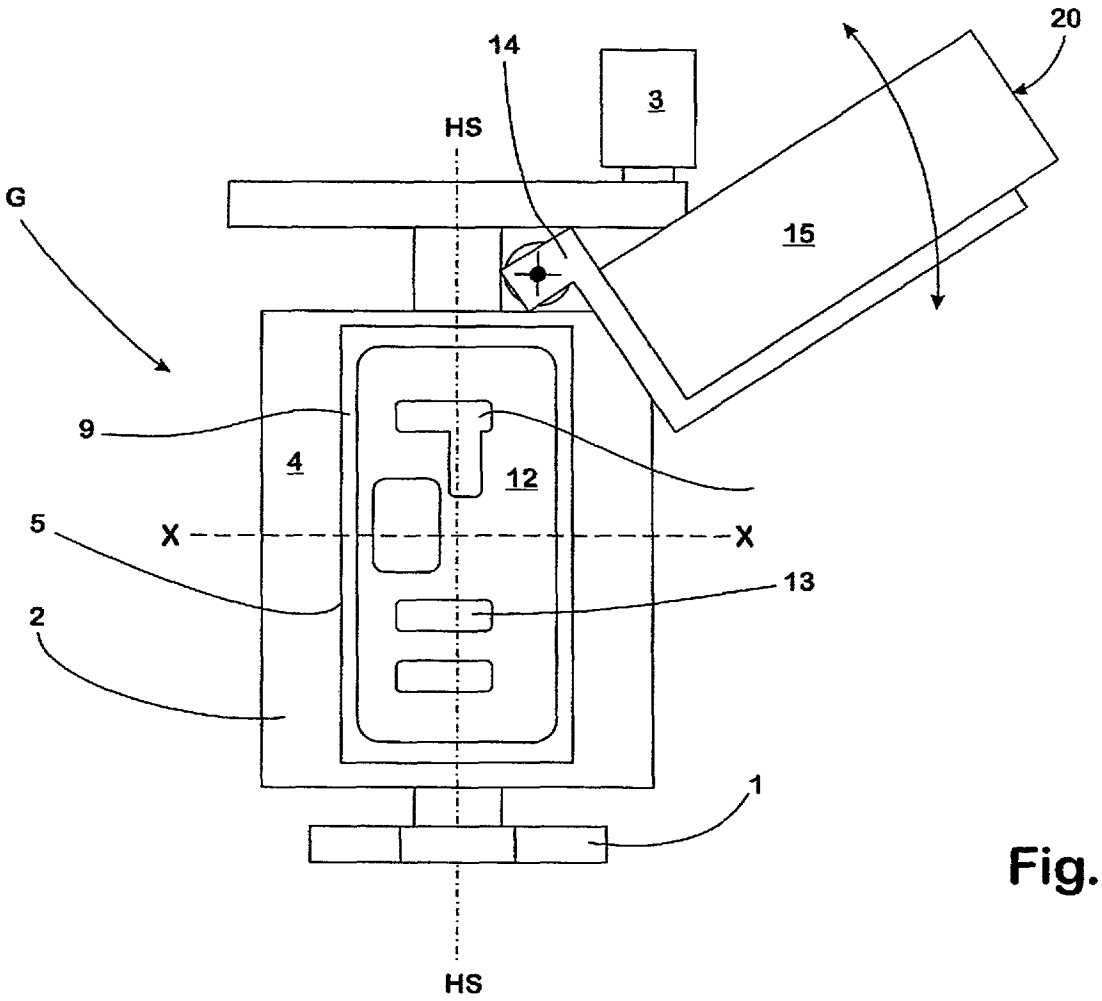
FIG. 2 the casting machine according to FIG. 1 in a plan view.

The casting machine G has a base plate 2 which is mounted in a base frame 1 and which can be pivoted about a horizontally aligned pivot axis HS by means of a pivot drive 3. When the casting machine G is in the starting position (FIG. 1), the base plate 2 is aligned horizontally.

A casting mould 5 for casting a cylinder head, a crankcase or an engine block for an internal combustion engine, for example, and composed as a core package of a plurality of casting cores 6-11 precast in a known way is built onto a mounting surface 4 formed on the upper side of the base plate 2. The moulding material which the mould cores 6-11 consist of is a mixture of a moulding sand, optionally present additives and a binder which is solidified by chemical treatment or by addition of heat, in order to achieve the required mould stability. Of course, individual cores or parts of the casting mould 5 can also consist of other materials, so that that they can be reused. Equally, chills (not illustrated here) or suchlike can be present in the casting mould 5, so that a directed solidification of the melt filled into the casting mould 5 can be produced.

The casting mould, which for the sake of clarity is only illustrated here in rough detail, comprises a bottom 6, side walls 7, 8 which form the lateral, outer end of the casting mould 5, a lid 9 and casting cores 11 which are arranged within the mould cavity 10 defined by the casting mould 5 and which form channels and/or hollow spaces in the cast part to be cast. The bottom 6 and the side walls 7, 8 can, for example, be produced as casting cores consisting of moulding material or as permanent casting mould parts consisting of a metal material, such as a heat-resisting steel material, or consisting of a copper material. With regard to the removability from the mould of the cast part to be cast in the casting mould 5, however, only the lid 9 typically consists of moulding material, whereas the bottom 6 and the side walls 7, 8 are designed as permanent mould parts.

A trough-like recess 12 is formed into the lid 9 from its top side, in the bottom of which recess 12 ingates 13 serving as filling openings end, via which the mould cavity 10 of the casting mould 5 can be filled with melt.

The casting machine G additionally comprises a pivoting and positioning device 14 which is also mounted on the base plate 2. By means of the device 14, a tundish 15 can be pivoted between a standby position, in which it is in each case outside the area which is required before the casting process for building the casting mould 5 onto the base plate 2 or after the casting process has been completed for removing the casting mould 5, and a pouring-in position, in which it is arranged with its pouring-out side 16 abutting on the outside 17 of the lid 9.

The tundish 15, which is open on its pouring-out side 16 and top side O and is manufactured from a fire-proof material, defines a tundish area 22 with its bottom 18, two longitudinal side walls 19, 20, which are arranged parallel to one another and extend along the bottom 18, and a rear wall 21. The rear wall 21 extends parallel to the open pouring-out side 16 between the ends of the longitudinal side walls 19, 20 assigned to it and has on its side assigned to the tundish area 22 an inflow surface 23 which starting from the flat bottom area of the bottom 18 assigned to the tundish area 22 rises obliquely in the direction of the free upper edge of the rear wall 21.

In its operating position the tundish 15 is held by the device 14 on the casting mould 5 such that the tundish 15 with the respectively free face sides of the longitudinal side walls 19, 20 and of the bottom 18 sits tightly on the assigned contact surfaces of the lid 9 of the casting mould 5.

During assembly of the casting mould 5, the base plate 2 with the casting mould 5 built onto it is in the starting position. The pivot angle β2 about the pivot axis HS is equal to "0" in this position.

Figure 3:
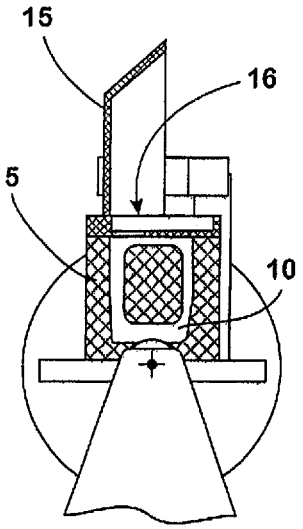
FIG. 3 the casting machine according to FIG. 1 in a starting position with the tundish arranged on it, in a side view.

After the casting mould 5 has been built onto the base plate 2, the device 14 places the tundish 15 with its pouring-out side onto the lid 9 of the casting mould 5 (FIG. 3). The device 14 holds the tundish in this position on the casting mould 5 until the casting process is complete.

When the tundish 15 is positioned in place on the casting mould 5, the side wall 7 of the casting mould arranged closest in this position to the bottom 18 of the tundish 15 represents the reference side wall which is critical for determining the pouring-in position in which the tundish 15 is filled with melt. The side wall 7 has wall areas 24 on its side assigned to the mould cavity 10, which form mould areas on the assigned lateral outer surface of the cast part to be cast. Each of the wall areas 24 has a certain orientation in relation to the pivot axis HS, which in each case can be indicated by a vector VW applied to the respective wall area 24 and aligned perpendicularly to the pivot axis HS.

A virtual main plane HE is placed into the side wall 7 in order to determine the pivot angle β2, about which the casting mould 5 with the tundish 15 has to be pivoted from the starting position into the pouring-in position, this main plane HS, on the one hand, extending parallel to the pivot axis HS and, on the other hand, being aligned in such a way that its alignment is approximated to the average of the alignments of the wall areas 24 indicated by the vectors VW, which in each case also extend in a direction aligned parallel to the pivot axis.

Figure 4:
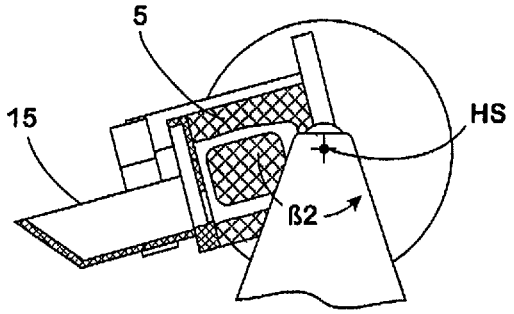
FIG. 4 the casting machine according to FIG. 1 in the pouring-in position in a side view.
Figure 5:
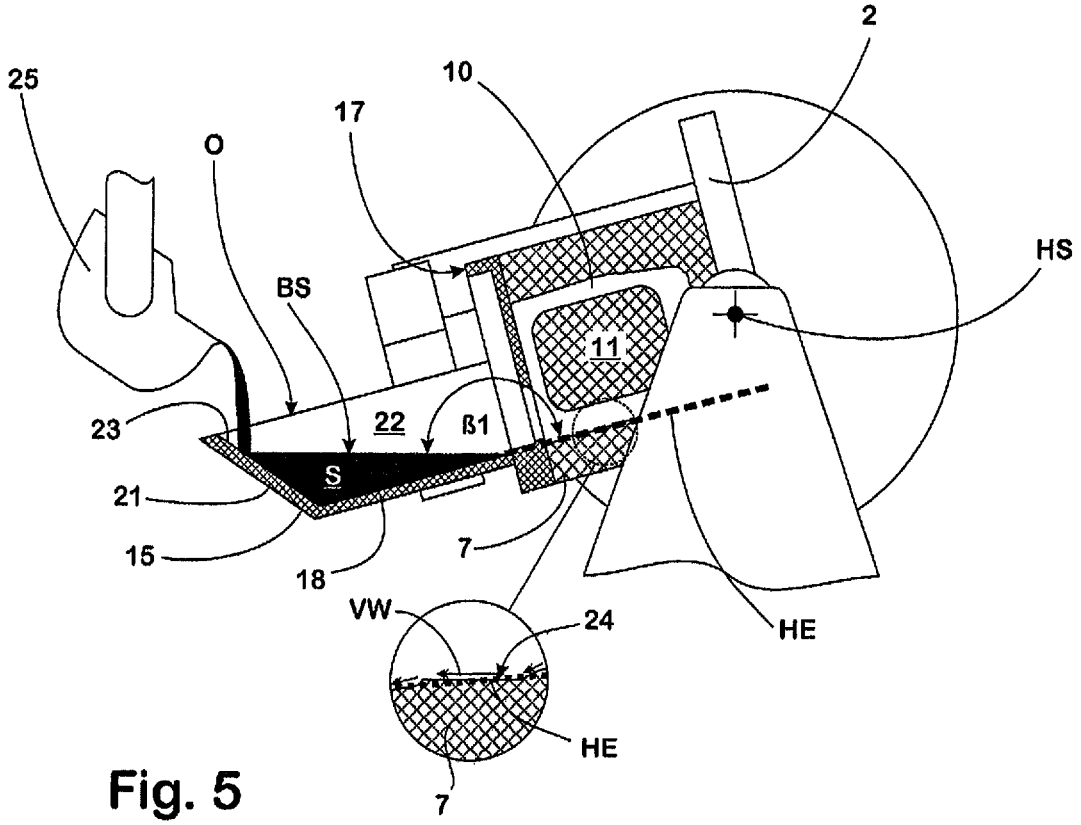
FIG. 5 the casting machine according to FIG. 4 when melt is poured into the tundish, in a side view.
Figure 6:
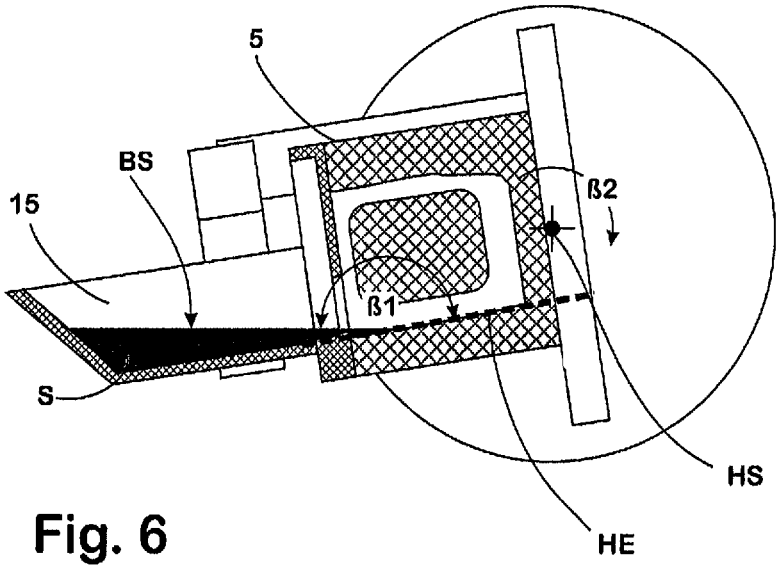
FIGS. 6-8 the casting machine according to FIG. 1 in different pivot positions in a side view and FIG. 9 the casting machine in the end position reached after the pivoting movement has been completed, in a side view.
Figure 7:
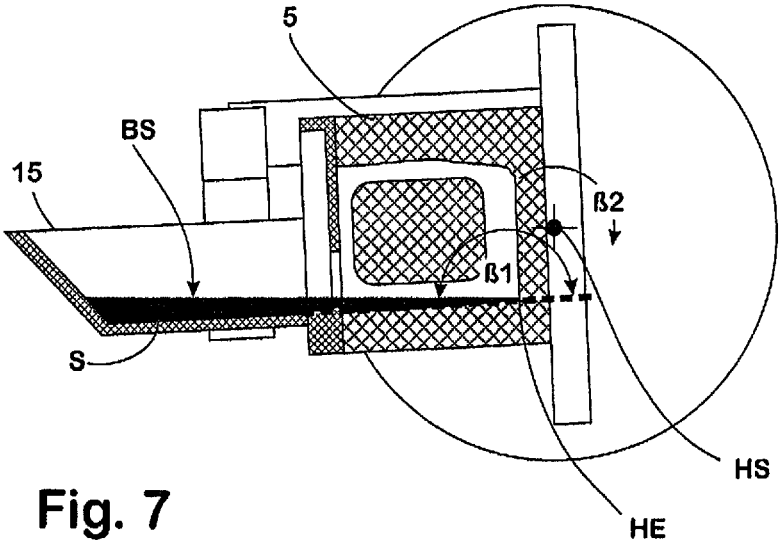
Figure 8:
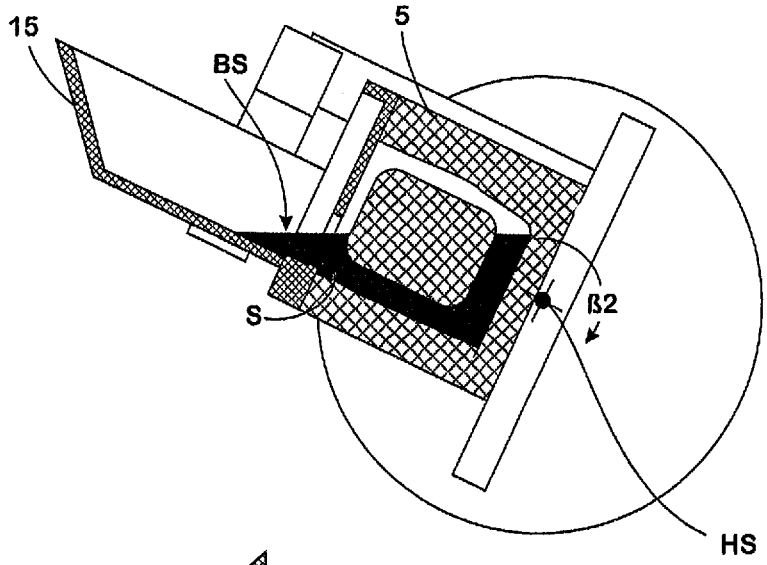
Figure 9:
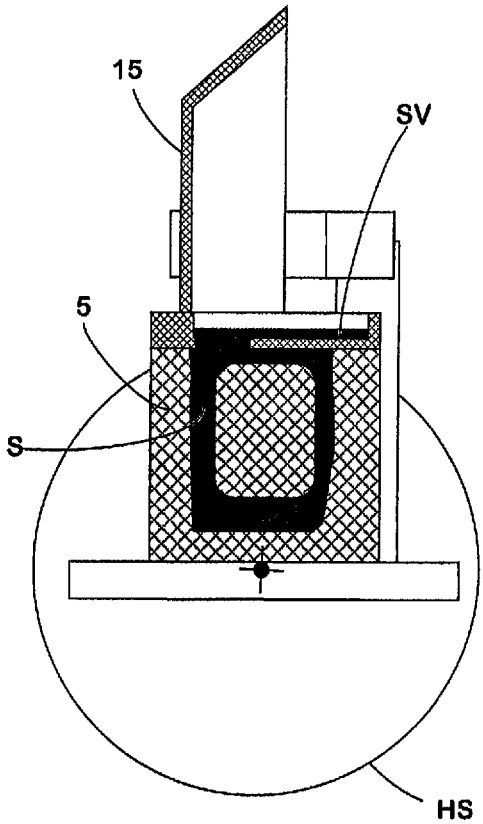

The pivot angle β2, about which the casting mould 5 is pivoted after coupling the tundish 15 in the example illustrated here anticlockwise about the pivot axis HS from the starting position shown in FIG. 3 into the pouring-in position shown in FIGS. 4, 5, is now selected such that the angle β1 enclosed between the top of the bath level BS (which at this time is still virtual) of the molten metal portion S to be filled into the tundish 15 and the main plane HE of the reference side B is less than 180°. In the exemplary embodiment illustrated here, this angle β1 is, for example, 135-165°, whereas the pivot angle β2 is in the range from 110-160°, in particular from 120-150°.

It is additionally taken into account when determining the pivot angle β2 that the bath level BS, when the casting mould 5 and tundish 15 are pivoted into the pouring-in position, is below the ingate 13 of the casting mould 5 which is arranged in this position at the bottommost in the lid 9.

After the combination consisting of the casting mould 5 and tundish 15 has been pivoted about the angle β2 determined in the above explained way into the pouring-in position, the molten metal portion S is filled into the tundish 15 by means of a conventional pouring ladle 25. An aluminium cast alloy is used as the molten metal here, as is usually used for casting parts for internal combustion engines. In order to ensure that the filling of the tundish 15 is as smooth and as free from turbulence as possible, the pouring stream 26 of molten metal leaving the pouring ladle 25 is directed at the inflow surface 23 of the tundish 15. The stream 26 striking there with the removal of kinetic energy is diverted in the direction of the bottom area of the tundish 15 and in this way hits the melt S already present in the tundish 15 in a comparably smooth flow distributed over a larger width.

After filling of the tundish 15 has been completed, the casting mould 5 with the tundish 15 is pivoted back clockwise towards the starting position. With increasing pivoting more and more melt S flows into the mould cavity 10 of the casting mould 5 until finally when the end position (=starting position) is again reached the molten metal portion S is completely filled into the casting mould 5. Excess melt volume is taken up by the recess 12 in the lid 9. The melt volume collected there when the casting mould 5 has been completely pivoted serves as a feeder to compensate for material shrinkage occurring in the course of solidification of the melt.

The pivot angle β2 selected for the pouring-in position was set in a manner according to the invention such that the angle β1 between the bath level BS and the main plane HB of the side wall 7 is constantly less than 180° until the melt S flowing into the casting mould 5 hits the bottom 6 of the casting mould. By means of this setting, it is ensured that the melt S at an acute angle runs horizontally against the wall areas 24 of the reference side wall (side wall 7). In this way, the casting mould 5 can be filled smoothly and in layers, which provides optimum conditions for forming a uniform microstructure in the finished cast part. Foam formation on the melt is to the greatest possible extent prevented. The cast part obtained is also to the greatest possible extent free of inclusions or other damaged spots due to the smooth filling operation. Contaminants and oxides which could cause such inclusions collect in an upper layer of the feeder volume SV formed from residual melt S in the recess 12, whereas at most small residues remain behind in the tundish 15, which can be easily removed.

REFERENCE SYMBOLS

β1 Angle enclosed between the top of the bath level BS and the main plane HE
β2 Pivot angle
BS Bath level of the molten metal S present in the tundish 15
G Casting machine
HS Pivot axis
HE Main plane of the reference side wall (side wall 7)
S Molten metal
SV Feeder
O Top side of the tundish 15
VW The alignment of the vectors indicating the wall areas 24
1 Base frame
2 Base plate
3 Pivot drive
4 Mounting surface
5 Casting mould
6 Bottom
7 Side wall (Reference side wall)
8 Side wall
9 Lid
10 Mould cavity
11 Mould core
12 Recess
13 Ingates
14 Pivoting and positioning device
15 Tundish
16 Pouring-out side
17 Outside of the lid 9
18 Bottom of the tundish 15
19, 20 Longitudinal side walls of the tundish 15
21 Rear wall of the tundish 15
22 Tundish area
23 Inflow surface of the tundish 15
24 Wall areas of the side wall 7
25 Pouring ladle
26 Pouring stream

The invention claimed is:

1. A method for casting cast parts from a molten metal using a casting mould pivotably mounted about a horizontally aligned pivot axis in a casting machine, the casting mould defining a mould cavity shaping the cast part to be cast in each case and having a lid delimiting the mould cavity on its one side, on which at least one filling opening is provided for feeding molten metal into the mould cavity, a reference side wall abutting on the lid and delimiting the mould cavity on its one side with wall areas, into which a main plane of the reference side wall running axially parallel to the pivot axis is placed in such a way that its alignment is approximated to the average of the alignments of the wall areas, which also in each case extend in a direction aligned parallel to the pivot axis, and a bottom whose bottom areas assigned to the mould cavity shape the bottom end of the cast part, and using a tundish which on its pouring-in side for pouring the molten metal into the tundish and on a pouring-out side abutting on the pouring-in side and on a bottom of the tundish is at least in sections open in each case, via which the molten metal filled into the tundish in casting operation flows out of the tundish into the casting mould, comprising the following production steps:

arranging the tundish on the casting mould in such a way that its pouring-out side butts against the lid of the casting mould and the bottom of the tundish is assigned to the reference side wall, wherein the pouring-in opening of the casting mould and the open section of the pouring-out side at least overlap one another;

pivoting the casting mould into a pouring-in position, in which the main plane of the reference side wall encloses an angle β1 that is less than 180° with a bath level of a molten metal portion to be filled into the tundish and the bath level of the molten metal portion to be filled into the tundish is located below the filling opening of the casting mould;

filling the tundish, which is in the pouring-in position, with the molten metal portion which is sufficient for filling the casting mould; and pivoting the casting mould with the tundish arranged on it about the pivot axis into a pivot direction, in which as a result of the pivoting molten metal flows out of the tundish into the casting mould, wherein the pivoting is continued until an end position is reached, in which the casting mould is filled with molten metal, and wherein the angle β1 enclosed in each case between the main plane of the reference side wall and the bath level of the molten metal portion, which is contained in the tundish in each case, is at least constantly less than 180° until the melt flowing into the casting mould hits the bottom of the casting mould, wherein a recess is formed into the lid of the casting mould, which when the casting mould is completely pivoted takes up a melt volume which serves as a feeder.

2. The method according to claim 1, wherein the bottom of the tundish is flat on its side facing the molten metal.

3. The method according to claim 2, wherein a bottom area formed on the inside of the tundish encloses a right angle with the bottom of the casting mould.

4. The method according to claim 2, wherein the pouring-out side of the tundish assigned to the casting mould is open.

5. The method according to claim 2, wherein the filling opening of the casting mould extends over the side of the lid of the casting mould assigned to the tundish.

6. The method according to claim 2, wherein an inflow surface is formed on the side of one of the closed walls of the tundish facing the molten metal, this inflow surface being inclined starting from the bottom in the direction of the upper free edge of this wall and at which the molten metal is directed when the molten metal is poured into the tundish.

7. The method according to claim 2, wherein the angle β1 is 120-160° when the casting mould is in the pouring-in position.

8. The method according to claim 1, wherein a bottom area formed on the inside of the tundish encloses a right angle with the bottom of the casting mould.

9. The method according to claim 1, wherein the pouring-out side of the tundish assigned to the casting mould is open.

10. The method according to claim 1, wherein the filling opening of the casting mould extends over the side of the lid of the casting mould assigned to the tundish.

11. The method according to claim 1, wherein an inflow surface is formed on the side of one of the closed walls of the tundish facing the molten metal, this inflow surface being inclined starting from the bottom in the direction of an upper free edge of this wall and at which the molten metal is directed when the molten metal is poured into the tundish.

12. The method according to claim 1, wherein the angle β1 is 120-160° when the casting mould is in the pouring-in position.

13. The method according to claim 1, wherein two or more ingates open out onto the lid as pouring-in openings, via which the melt flows into the mould cavity of the casting mould when pivoting into the end position.

14. The method according to claim 1, wherein the molten metal when pivoting into the end position runs directly against the lid of the casting mould and flows into the respectively available pouring-in opening there.

15. The method according to claim 1, wherein the pivot angle covered by the casting mould with the tundish arranged on it between the pouring-in position and the end position is 110-160°.

16. The method according to claim 1, wherein the pivot axis runs through or close to the bottom of the casting mould.

17. The method according to claim 1, wherein the molten metal is a light metal melt.

18. The method according to claim 1, wherein the cast part to be cast is a cylinder head or a crankcase for an internal combustion engine.

* * * * *